US006290998B1

(12) United States Patent
Layton et al.

(10) Patent No.: US 6,290,998 B1
(45) Date of Patent: Sep. 18, 2001

(54) SINGLE EYELET/NOTCHED NYLON CLOSURE FOR COOKING BAG

(75) Inventors: Larry L. Layton, Forest Hill; Christina K. Minnick, Millers Island; Kim S. Torppey, Baltimore; Jeanne B. Speight, West Friendship; Richard D. Toohey, Lutherville; Janice B. Barbour, Hampstead, all of MD (US)

(73) Assignee: McCormick & Company, Inc., Hunt Valley, MD (US)

( * ) Notice: Subject to any disclaimer, the term of this patent is extended or adjusted under 35 U.S.C. 154(b) by 0 days.

(21) Appl. No.: 09/387,768

(22) Filed: Sep. 1, 1999

(51) Int. Cl.[7] ..... B65B 51/00

(52) U.S. Cl. ..... 426/113; 426/118; 426/129; 383/70; 383/71

(58) Field of Search ..... 426/113, 118, 426/129, 395, 403, 410, 412, 415, 111; 383/70, 71; 24/30.5 P, 16 PB

(56) References Cited

U.S. PATENT DOCUMENTS 1,945,932 * 2/1934 Caley ..... 132/247
3,365,753 * 1/1968 Prenner et al. ..... 24/16 PB
3,867,249 * 2/1975 Vitale et al. ..... 161/116
3,881,023 * 4/1975 Wilson ..... 426/132
3,974,960 * 8/1976 Mitchell ..... 229/62
4,077,562 * 3/1978 Ballin ..... 229/62
4,477,950 * 10/1984 Cisek et al. ..... 24/30.5 P
4,510,649 * 4/1985 Yudis et al. ..... 24/16 PB
4,881,301 * 11/1989 Sweeney et al. ..... 24/30.5 R
4,942,644 * 7/1990 Rowley ..... 24/16 PB
5,502,877 * 4/1996 Yocum ..... 24/16 PB
5,878,520 * 3/1999 Milbrandt et al. ..... 40/665

* cited by examiner

*Primary Examiner*—Nina Bhat
(74) *Attorney, Agent, or Firm*—Oblon, Spivak, McClelland, Maier & Neustadt, P.C.

(57) ABSTRACT

A cooking bag for edible food contents is secured by a closure in a coiled circle around a neck of the bag. The closure has a single eyelet and a pair of notches which catch in the single eyelet. A distance from the pair of notches to a center of the single eyelet is nonadjustable and predetermined. As a result, spillage of the edible food contents from the bag is prevented while steam is allowed to vent from the bag during cooking.

8 Claims, 5 Drawing Sheets

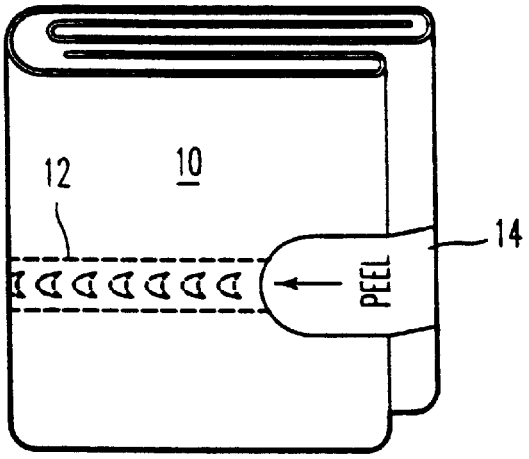
FIG. 1A
PRIOR ART
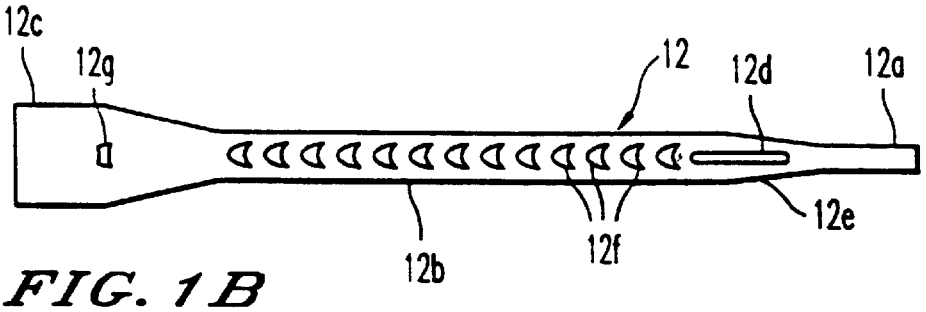
FIG. 1B
PRIOR ART
FIG. 1C
PRIOR ART
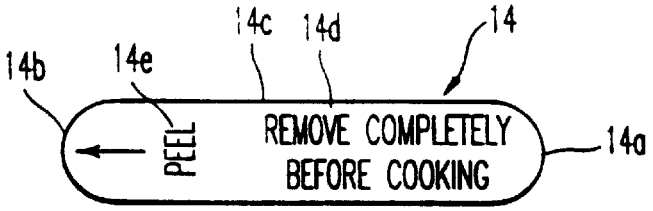
FIG. 1D
PRIOR ART
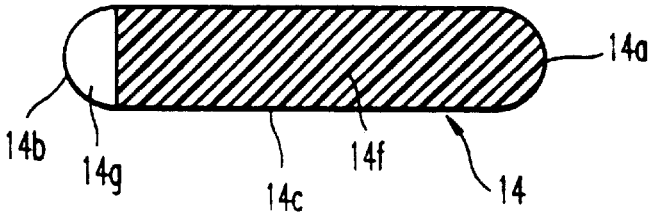

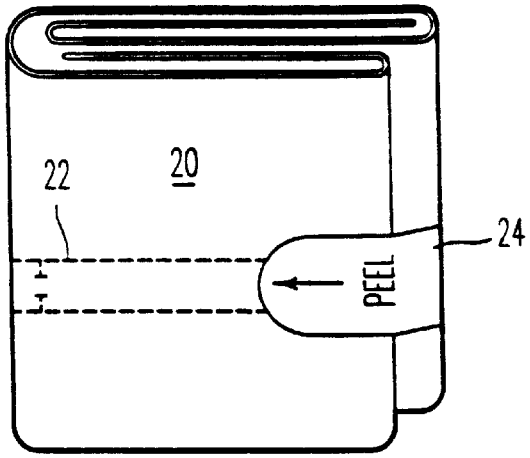
FIG. 3A
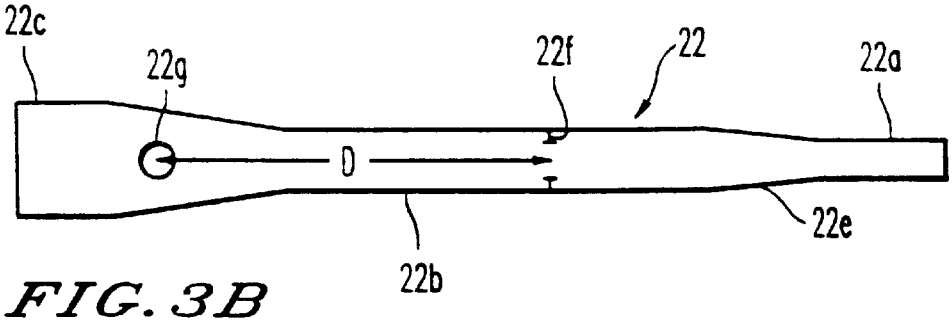
FIG. 3B
FIG. 3C
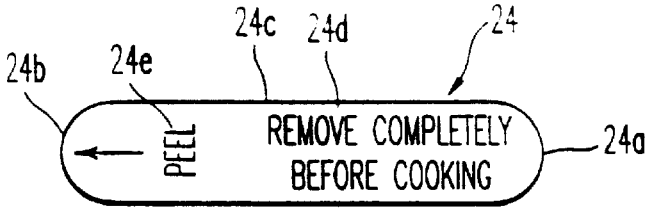
FIG. 3D
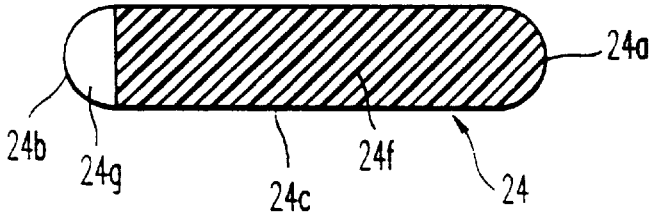

SINGLE EYELET/NOTCHED NYLON CLOSURE FOR COOKING BAG

BACKGROUND OF THE INVENTION

1. Field of the Invention

The present invention relates to a closure or tie, in particular for a cooking bag containing edible food contents.

2. Description of Related Art

It is well known in the art of cooking to provide a flexibly adjustable closure for tying a bag shut so that edible food contents therein do not escape therefrom during high heating and boiling steps.

An exemplary prior art closure and bag are shown in FIGS. 1A–1D and 2. As seen in FIG. 1A, an 11"×17" cooking bag 10 made of clear flexible plastic, such as nylon nucleated film, is folded tightly into a two-inch square. In this folded condition, the bag 10 is about one-half inch thick. Each fabricated bag 10 is capable of withstanding a desired force or pressure, for example, holding a minimum of 18" of water pressure when tested. An adjustable closure 12, preferably a colored nylon tie, is placed inside the bag 10 prior to the last fold. The bag 10 with the closure 12 inside is then secured in its folded condition by a pressure sensitive label 14.

The adjustable closure 12 is shown in its flat, laid-out condition in FIG. 1B. The closure 12 has a shape similar to an arrow with a thin head 12*a,* a long midsection 12*b,* and a wide tail 12*c*. The head 12*a* has a longitudinal slot 12*d* in a widened portion 12*e* which joins the midsection 12*b*. A plurality of identical cutouts 12*f* is punched along a length of the midsection 12*b* to make the closure 12 adjustable to a selected one of the cutouts 12*f*. The tail 12*c* has a noncircular catch 12*g* cut therein.

A top view of the label 14 is shown with two sets of instructions printed thereon in FIG. 1C. The label 14 has an oblong shape with rounded ends 14*a* and 14*b*. On a main body 14*c,* a first set of instructions 14*d* is printed. A second set of instructions 14*e* is printed on the second rounded end 14*b*.

FIG. 1D illustrates a bottom view of the label 14. An adhesive 14*f* covers the first rounded end 14*a* and the main body 14*c* while the second rounded end 14*b* has an ungummed portion 14*g*.

FIG. 2 depicts the prior art device in use. To assemble the bag into this arrangement, the ungummed portion 14*g* of the second rounded end 14*b* is first gripped by the user and the label 14 is peeled back from the folded bag 10 in the direction of an arrow A. The bag 10 in FIG. 1A is then unfolded to its full 11"×17" size and the closure 12 is removed. The bag 10 in FIG. 2 is then opened at one end 10*a* opposite to a sealed end 10*b* and, after edible food contents 16 to be baked or otherwise cooked are placed inside the opened bag 10, the user grabs the bag 10 near to its end 10*a* and bunches up the bag 10 to form a neck 10*c* which is then encircled by the closure 12. Subsequently, the user threads the thin head 12*a* through the catch 12*g* and pulls the closure 12 tightly therethrough until one of the cutouts 12*f* gets caught in the catch 12*g* and the closure 12 cannot be pulled through any farther.

With this arrangement, the bag 10 is closed as tightly as the user pulls the closure 12 through the catch 12*g*. However, one user may pull the closure 12 more or less tightly than another so that the particular cutout 12*f* which gets caught in the catch 12*g* can vary from user to user. Unfortunately, with this prior art device, sometimes the user does not pull the closure 12 tightly enough and the food contents 16 leak out of the bag 10. In fact, if the closure is very loose, it can slip off the bag, leaving the bag mouth unfastened. At other times, the user pulls the closure 12 excessively so that the closure 12 either breaks or tears, or the bag 10 bursts during cooking because steam cannot vent therefrom through the one end 10*a*. If steam cannot escape from bag 10 during high temperature cooking, perforations must be provided in the bag to prevent rupture. However, user's may inadvertently fail to perforate bag 10 before cooking.

Thus, it remains a problem in the prior art to provide a closure which will consistently seal a cooking bag so that the open end thereof will be constricted sufficiently to prevent spillage of the food contents therefrom while steam is also allowed to vent from the bag during cooking.

SUMMARY OF THE INVENTION

The present invention relates to a nonadjustable closure with a single eyelet and a matched pair of notches for engaging the eyelet so that a cooking bag may be sealed to a tightness predetermined by the manufacturer.

It is therefore a primary object of the present invention to provide a nonadjustable closure for a cooking bag which will sufficiently constrict the bag opening to prevent spillage of food contents but which will also allow steam to vent from the bag.

BRIEF DESCRIPTION OF THE DRAWINGS

Other objects and advantages of the present invention will become readily apparent from the description of the invention herein, particularly when read in conjunction with the accompanying drawing figures.

FIG. 1A is a perspective view of a prior art cooking bag in a folded and sealed condition.

FIG. 1B is a top plan view of a prior art adjustable closure.

FIG. 1C is a top plan view of a prior art label.

FIG. 1D is a bottom plan view of the prior art label.

FIG. 3A is a perspective view of a cooking bag used with the nonadjustable closure of the present invention in a folded and sealed condition.

FIG. 3B is a top plan view of the closure of the present invention.

FIG. 3C is a top plan view of a label used with the closure of the present invention.

FIG. 3D is a bottom plan view of the label used with the closure of the present invention.

DETAILED DESCRIPTION OF THE INVENTION

Figure 2:
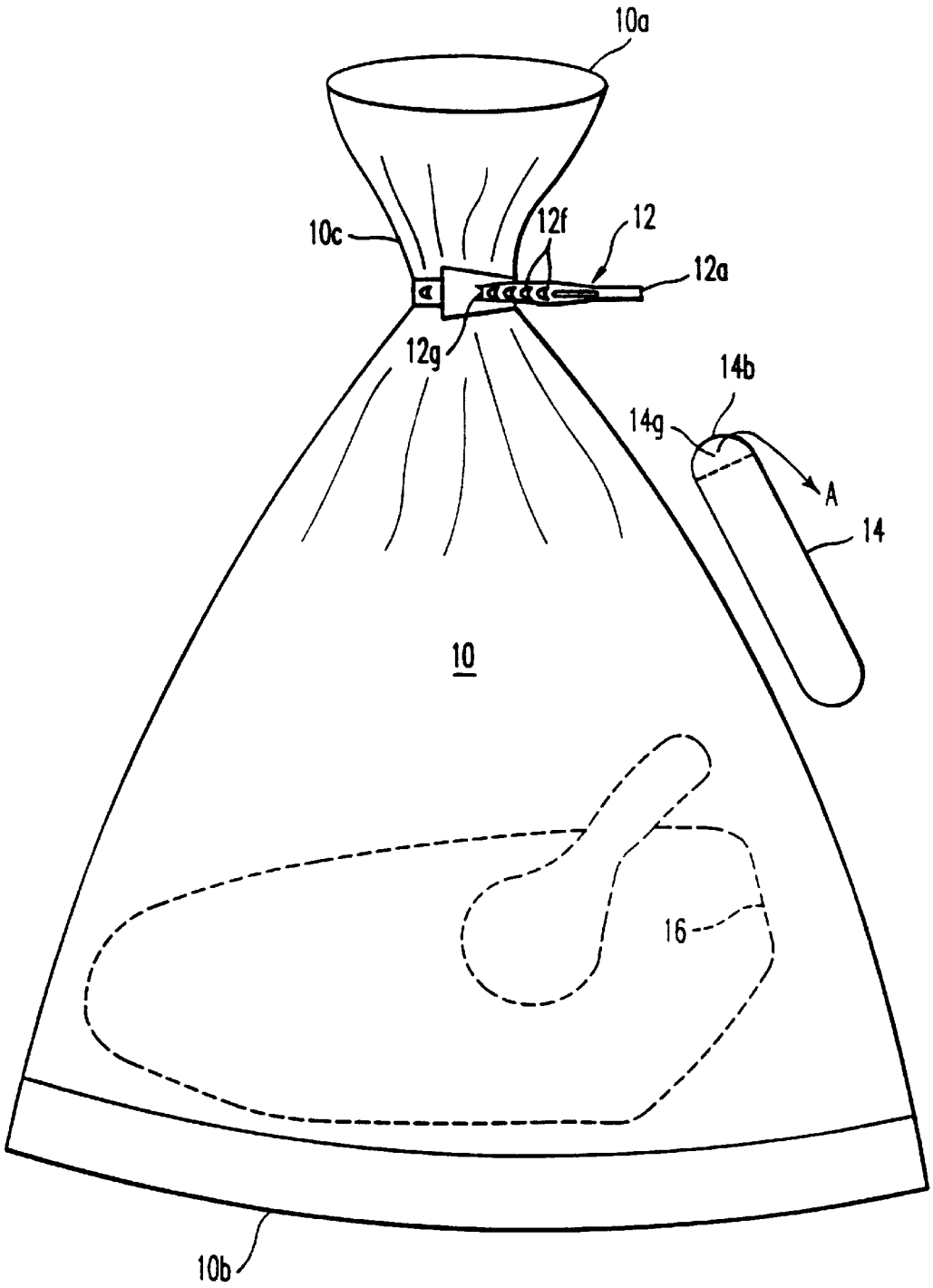
FIG. 2 PRIOR ART
FIG. 2 is a perspective view of the prior art cooking bag with the adjustable closure in use and the label removed therefrom.

As shown in FIG. 3A, the present invention is applicable to a conventional cooking bag, e.g. an 11"×17" cooking bag 20, which is made of a clear flexible plastic, such as a blend of nucleated nylon 6 and 66 resins. The bag 20 is folded tightly into a two-inch square. In this folded condition, the bag 20 is about a half-inch thick. Each fabricated bag 20 is capable of holding a minimum of 18" of water pressure when tested. A nonadjustable closure 22, preferably a colored tie made from nylon 66 film, is placed inside the bag 20 prior to the last fold. The bag 20 with the closure 22 inside is then secured shut in its folded condition by a pressure sensitive label 24. It is to be understood that the present invention can advantageously be utilized with bags of different sizes, shapes, materials or fold configurations, if desired. In addition, the tie closure could be attached to the exterior of the bag, or packed unattached to the bag as desired. Although the tie can be formed of any color, black is the presently preferred color for the tie closure 22, or, any color which contrasts with the clear plastic film of the bag 20 so that the user can see the tie closure 22 inside the folded bag 20. Black (or another contrasting color) is particularly preferred, since it will also contrast with most kitchen decor, so that the tie closure is less likely to be lost if it is inadvertently dropped.

In FIG. 3B, the nonadjustable closure 22 is shown in its flat, laid-out condition. The closure 22 has a shape similar to an arrow with a thin head 22*a,* a long midsection 22*b,* and a wide tail 22*c.* The head 22*a* has a widened portion 22*e* which joins the midsection 22*b.* A pair of T-shaped notches 22*f* is cut into opposite sides of the midsection 22*b.* The tail 22*c* has a single circular eyelet 22*g* punched therein. This eyelet 22*g* functions as a catch for the pair of notches 22*f* so that the closure 22 is nonadjustable. In other words, whenever the pair of notches 22*f* get caught in the eyelet 22*g,* the circumference of the looped closure 22 will always be the same. Although the eyelet 22*g* is shown to be a circular hole, it may be any shape which will catch and retain the pair of notches 22*f.* Furthermore, the single eyelet 22*g* guarantees that the consumer cannot make an error in securing the bag 20 with the closure 22 because there is only one option available. A distance D between the pair of notches 22*f* and a center of the circular eyelet 22*g* will be discussed later.

In FIG. 3C, a top view of a label 24 is shown with two sets of instructions printed thereon. The label 24 has an oblong shape with rounded ends 24*a* and 24*b.* On a main body 24*c,* a first set of instructions 24*d* is printed for reading by a user. A second set of instructions 24*e* is printed at the second rounded end 24*b.*

In FIG. 3D, a bottom view of the label 24 is illustrated. An adhesive 24*f* covers the first rounded end 24*a* and the main body 24*c* while the second rounded end 24*b* has an ungummed portion 24*g.*

Figure 4:
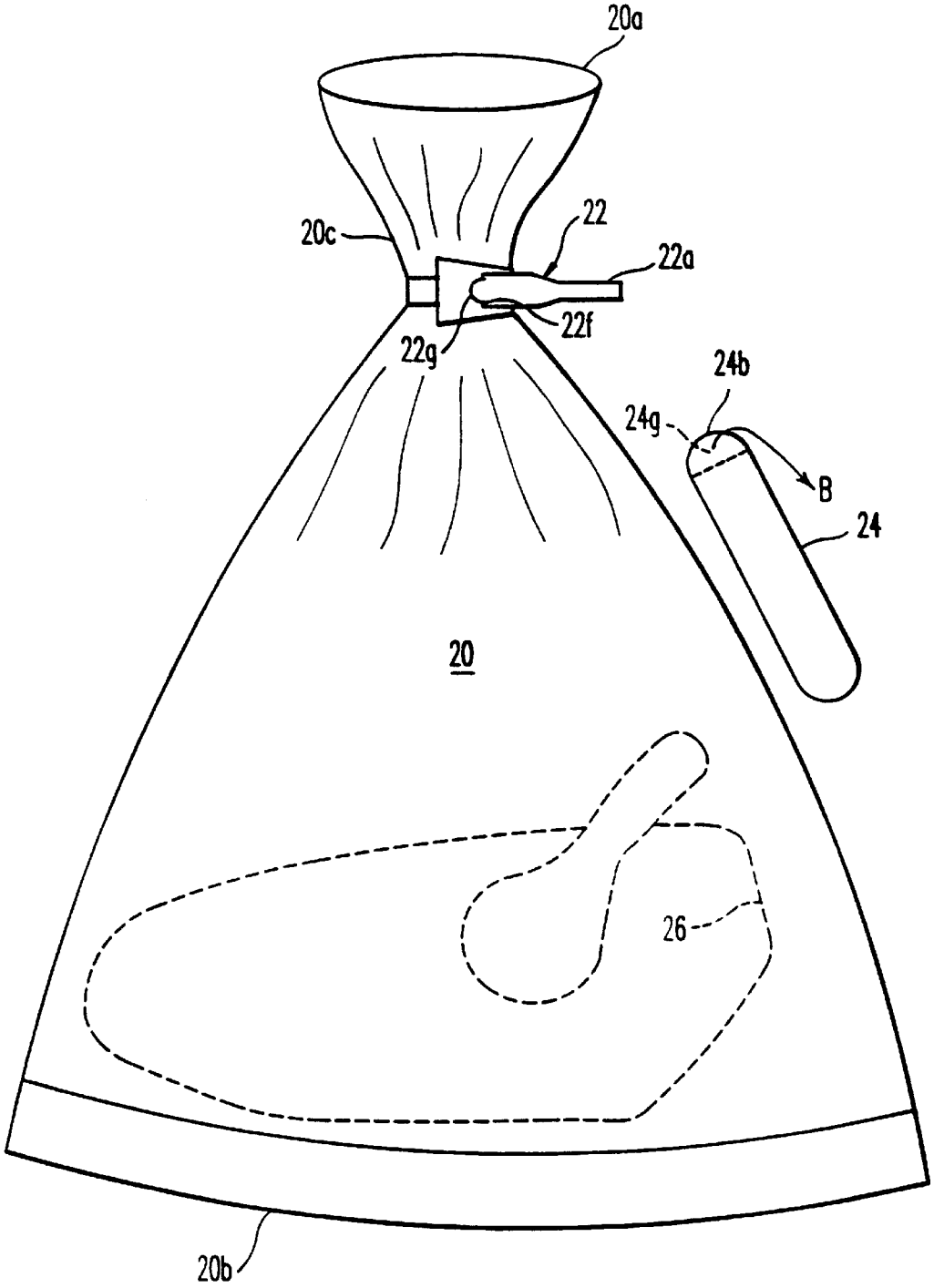
FIG. 4 is a perspective view of the cooking bag with the closure of the present invention in use and the label removed therefrom.

In FIG. 4, the use of the present invention is seen. First, the ungummed portion 24*g* of the second rounded end 24*b* is gripped by fingers of the user and the label 24 is peeled back from the folded bag 20 in the direction of an arrow B. The bag 20 in FIG. 3A is then unfolded to its full 11"×17" size and the closure 22 is removed therefrom. The bag 20 in FIG. 4 is then opened at one end 20*a* opposite to a sealed end 20*b.* After edible food contents 26 to be baked or cooked in another manner are placed inside the opened bag 20, the user grabs the bag 20 near to its one end 20*a* and bunches the bag 20 up to form a neck 20*c* around which the closure 22 is then coiled in a circle. Subsequently, the user threads the thin head 22*a* through the eyelet 22*g* and pulls the closure 22 tightly therethrough until the pair of T-shaped notches 22*f* get caught in the eyelet 22*g* and the closure 22 cannot be pulled through any farther. Thus, the bag 20 is closed to a tightness predetermined by the manufacturer to be most desirable to prevent the food contents 26 from leaking out and also to allow steam to vent from the one end 20*a* of the bag 20. Therefore, even if a user fails to perforate bag 10 before cooking, bag 10 is less likely to rupture due to excessive pressure.

Figure 5:
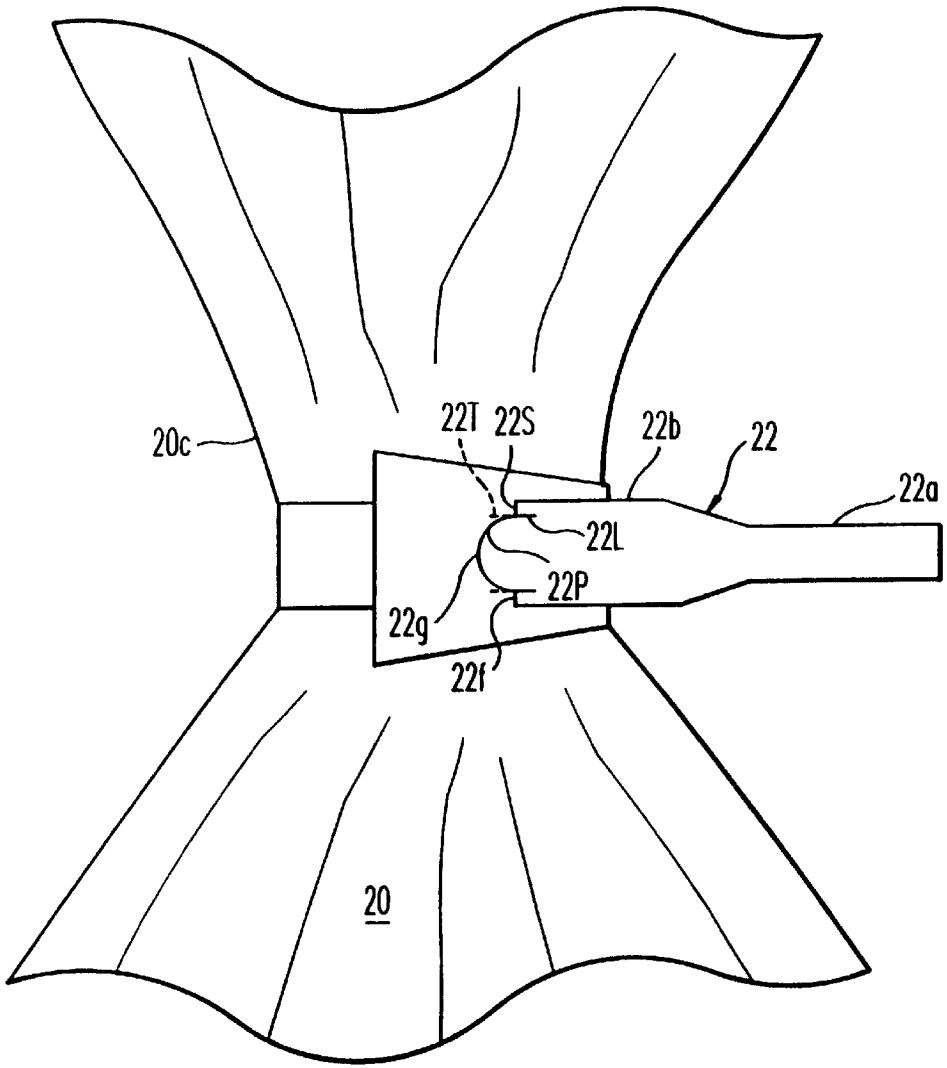
FIG. 5 is an enlarged perspective view of the closure of the present invention in use around a neck of the cooking bag.

As shown in FIG. 5, the T shape of each notch 22*f* advantageously facilitates the locking function because this T shape allows the closure 22 to lock into position around the neck 20*c* and does not permit the notches 22*f* to go past or reverse out of the locked position with the eyelet 22*g.* A stem portion 22S of each T-shaped notch 22*f* actually locks with a peripheral edge 22P of the circular eyelet 22*g* where they meet. A leading edge 22L of a top of each T-shaped notch 22*f* flexes or curls after the thin head 22*a* of the closure 22 is threaded by the user through the eyelet 22*g.* Immediately upon passing the point of contact on the peripheral edge 22P of the eyelet 22*g,* the leading edge 22L of the top of each T-shaped notch 22*f* flips out or on curls in order to prevent the notches 22*f* from loosening themselves from the eyelet 22*g,* thus locking the closure 22 around the neck 20*c* in a position preselected by the manufacturer. A trailing edge 22T of the top of each T-shaped notch 22*f* stays in its flat or unflexed state during the threading step, thus causing the eyelet 22*g* to stop any more forward movement of the head 22*a* at the location where the peripheral edge 22P of the eyelet 22*g* and the stem portion 22S of each T-shaped notch 22*f* comes into contact with each other. Because the width of the midsection 22*b* across the pair of notches 22*f* is larger than the diameter of the eyelet 22*g,* the head 22*a* cannot advance any farther to make the closure 22 tighter around the neck 20*c.* The distance between the tops of one T-shaped notch 22*f* and the top of the other T-shaped notch 22*f* is the same dimension as the diameter of the eyelet 22*g.* Thus, the trailing edge 22T of the top of each T-shaped notch 22*f* prevents any forward movement while the leading edge 22L of the top of each T-shaped notch 22*f* prevents any reverse movement which would cause the notches 22*f* to unlock from the eyelet 22*g.*

It is to be understood that while a T-shaped notch is presently preferred, other notch shapes or configurations are also possible in accordance with the present invention so long as the notch will catch within the opening of the tie and will restrict movement in both directions once caught. It is also to be understood that while a pair of notches are presently preferred, the present invention can also be practiced with a different number of notches. For example, a single notch on one side of the tie can also serve to provide an interlocking relationship with the opening in the tie and restrict movement in both the forward and reverse directions once interlocked. However, the use of a pair of notches is presently preferred for better performance. In accordance with the present invention, the tie advantageously provides a fixed circumference or periphery so that the tightness with which the tie encircles the bag mouth is not subject to user variation. As a result, more predictable performance of the cooking bag is assured, since this fixed relationship is sufficiently tight to avoid or minimize leakage of liquids from the bag, however steam or vapors are allowed to vent from the bag so that the bag will not break during cooking.

A desired circumference of a circle formed by the coiled closure 22 has been determined to be the distance D of two inches in FIG. 3B. This distance D extends from the pair of notches 22*f* to the center of the eyelet 22*g.* However, it is to be understood that this distance can vary depending upon a number of factors. For example, if a larger bag or a thicker bag is utilized, a larger circumference would be needed in order to provide the desired amount of tightness around the bag so that liquid leakage is sufficiently restrained while vapor/steam venting is also maintained. Further, it is possible that the desired amount of tightness could vary depending upon the intended cooking conditions. Thus, while a two inch circumference is presently preferred for an 11"×17" cooking bag for most anticipated cooking conditions, it is to be understood that various aspects of the present invention may be utilized with other dimensions as well. One of the primary advantages of the present invention is that, although the particular dimension provided by the closure about the bag can vary depending upon the bag design or other design factors, once the desired relationship is determined, this relationship is assured and is not subject to user variation.

Preferably, the tie closure is thin, i.e., thinner than that utilized with prior cooking bag arrangements. Providing a tie that is thinner than prior arrangements is advantageous in a number of respects. First, prior art arrangements with thicker ties tended to present difficulties in that after they were attached to the bag, they would expand. As a result, when the bags are inserted into a retail packaging container, such as a foil pouch (which is done utilizing automated equipment), less than the desired number of bags might be inserted if one of the bags or closures had expanded. Accordingly, a customer might occasionally purchase a pouch of cooking bags having a lesser number than that identified on the pouch, leading to customer complaints. The use of a thinner tie closure has also been recognized as advantageous in easing handling of the ties. The tie of the present invention is preferably less than 9 mils in thickness, and more preferably in the range of 5.9–8.1 mils. This range affords sufficient thickness so that the tie will not break under most conditions, while also providing a tie which is thinner and less likely to expand than prior cooking bag ties. The use of a thinner tie is further enabled by the non-adjustable aspect of the present invention, since the consumer is not left to guess as to the amount of tightness to which the tie must be pulled when fastening the tie closure about the neck of the bag, and accordingly, there is less risk that the user will impart an excessive amount of force to the tie which could result in breakage or tearing of the tie.

Returning to FIG. 4, it has been determined experimentally for the 11"×17" cooking bag 20 that making the distance D for the nonadjustable closure 22 much shorter than two inches, i.e. the neck 20*c* of the bag 20 is constricted more tightly, results in too little steam being vented through the one end 20*a* so that a risk of causing the bag 20 to burst during the cooking process is increased. Likewise, it has been determined experimentally for the same 11"×17" cooking bag 20 that making the distance D for the nonadjustable closure 22 much longer than two inches, i.e. the neck 20*c* of the bag 20 is tied very loosely, results in the contents 26 spilling through the one end 20*a* so that edible food is lost during the cooking process. It should be noted that the bag mouth when closed by the tie closure is not entirely liquid impervious, however, the bag is sufficiently resistant to leakage for normal use of the bag, while also providing sufficient venting of steam/vapor. Thus, this distance D of approximately two inches in FIG. 3B has been found to be particularly advantageous for superior results when utilized with the 11"×17" cooking bag 20 seen in FIG. 4. Of course, as discussed above, for differently sized cooking bags 20, different circumferences for other closures 22 encircling the necks 20*c* can be utilized consistent with the teachings of the present invention. Typically, the bag is placed on its side during cooking, and thus, is not required to be completely sealed to the extent that, if turned upside down, no leakage would occur. Rather, the bag need only be sufficiently tight such that leakage does not occur during normal use, e.g., with the bag on its side during cooking. In accordance with the present invention, the desired relationship so that spillage is avoided while venting is allowed is assured since this relationship is not subject to user variation as a result of the improved tie closure of the present invention.

Clearly, numerous modifications and variations of the present invention are possible in light of the above teachings. Thus, it is to be understood that, within the scope of the appended claims, the invention may be practiced otherwise than as specifically described herein.

What is claimed is:

1. A cooking bag assembly comprising:

a cooking bag including a first end having an opening therein, said bag further including a second end which is closed;

a closure member configured to encircle said first end to at least partially close said first end, said closure member including means to define a single fixed circumferential size which is not subject to user variation and which corresponds to a fixed amount of tightness of said closure member about said first end of said bag such that spillage from said bag is minimized while steam can vent from said bag through said first end.

2. A cooking bag assembly as recited in claim 1, wherein said closure member includes a head, and wherein said means to define a single fixed circumferential size includes a single eyelet adapted for receiving said head and at least one notch disposed at a location between said head and said single eyelet when said closure member is in an open position prior to encircling said first end of said bag, and further wherein said closure member is configured to be lockable about said first end of said bag by inserting said head into said eyelet and pulling upon said head until said notch is caught within said eyelet with said closure member having said single fixed circumferential size about said first end of said bag with said fixed amount of tightness.

3. A cooking bag assembly as recited in claim 2, wherein said closure member includes a pair of notches, wherein each of said pair of notches is spaced a same distance from said eyelet when said closure member is in said open position.

4. A cooking bag as recited in claim 2, wherein said at least one notch is T-shaped.

5. A cooking bag assembly as recited in claim 4, wherein said closure member includes first and second edges extending along a length of said closure member, and wherein said at least one notch which is T-shaped includes:

(i) a first slit extending from said first edge and in a direction toward said second edge, and (ii) a second slit extending substantially perpendicular to said first slit, wherein said second slit is spaced from said first edge and said first slit intersects said second slit.

6. A cooking bag assembly as recited in claim 3, wherein said closure member includes first and second edges extending along a length of said closure member, and wherein said pair of notches includes:

(a) a first T-shaped notch comprising:

(i) a first slit extending from said first edge and in a direction toward said second edge, and (ii) a second slit extending substantially perpendicular to said first slit, wherein said second slit is spaced from said first edge and said first slit intersects said second slit; and (b) a second T-shaped notch comprising:

(i) a third slit extending from said second edge and in a direction toward said first edge, and (ii) a fourth slit extending substantially perpendicular to said third slit, wherein said fourth slit is spaced from said second edge and said third slit intersects said fourth slit.

7. A cooking bag assembly as recited in claim 6, wherein said bag is an 11 inch by 14 inch bag and said fixed circumferential size is approximately two inches.

8. A cooking bag assembly as recited in claim 6, wherein a distance between the second slit and the fourth slit is the same as a diameter of said eyelet.

* * * * *

UNITED STATES PATENT AND TRADEMARK OFFICE

CERTIFICATE OF CORRECTION

PATENT NO. : 6,290,998 B1 
DATED : September 18, 2001
INVENTOR(S) : Larry L. Layton et al.

It is certified that error appears in the above-identified patent and that said Letters Patent is hereby corrected as shown below:

Title page,
Item [75], add -- John A. Menges --.

Signed and Sealed this

Tenth Day of June, 2003

JAMES E. ROGAN
*Director of the United States Patent and Trademark Office*